US010636380B1

(12) United States Patent
Xu

(10) Patent No.: US 10,636,380 B1
(45) Date of Patent: Apr. 28, 2020

(54) PIXEL DRIVING CIRCUIT, PIXEL DRIVING METHOD AND LIQUID CRYSTAL DISPLAY DEVICE

(71) Applicant: SHENZHEN CHINA STAR OPTOELECTRONICS TECHNOLOGY CO., LTD., Shenzhen, Guangdong (CN)

(72) Inventor: Xiangyang Xu, Guangdong (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 176 days.

(21) Appl. No.: 16/069,283

(22) PCT Filed: Mar. 20, 2018

(86) PCT No.: PCT/CN2018/079657
§ 371 (c)(1),
(2) Date: Jul. 11, 2018

(87) PCT Pub. No.: WO2019/165655
PCT Pub. Date: Sep. 6, 2019

(30) Foreign Application Priority Data

Feb. 28, 2018 (CN) ..... 2018 1 0168216

(51) Int. Cl.
*G09G 3/36* (2006.01)

(52) U.S. Cl.
CPC ..... *G09G 3/3688* (2013.01); *G09G 3/3677* (2013.01); *G09G 3/3607* (2013.01);
(Continued)

(58) Field of Classification Search
CPC ..... G02F 1/13306; G02F 1/133707; G02F 1/133784; G02F 1/1343; G02F 1/134309;
(Continued)

(56) References Cited

U.S. PATENT DOCUMENTS 7,872,622 B2 * 1/2011 Kim ..... G02F 1/13624 345/87
8,253,669 B2 * 8/2012 Ina ..... G02F 1/134336 345/87
(Continued)

FOREIGN PATENT DOCUMENTS

CN 101021660 A 8/2007
CN 101363982 A 2/2009
(Continued)

*Primary Examiner* — Michael J Eurice
(74) *Attorney, Agent, or Firm* — Leong C. Lei

(57) ABSTRACT

Provided are a pixel driving circuit, a pixel driving method and a liquid crystal display device. Each pixel unit of the pixel driving circuit comprises a first sub pixel and a second sub pixel. A first sub pixel and a second sub pixel in a column of pixel units are respectively connected to one data line and one auxiliary line, and meanwhile, control units receiving the first and second control signals are arranged. Each control unit is coupled to an auxiliary line and a data line connected to a column of pixel units. The control unit is controlled by the first control signal and the second control signal to disconnect the data line from the auxiliary line and to connect the auxiliary line to the common electrode line, or to connect the data line to the auxiliary line and to disconnect the auxiliary line from the common electrode line.

8 Claims, 3 Drawing Sheets

(52) U.S. Cl.
CPC ..... *G09G 3/3648* (2013.01); *G09G 3/3659* (2013.01); *G09G 2300/0439* (2013.01); *G09G 2300/0447* (2013.01); *G09G 2310/0202* (2013.01); *G09G 2310/0297* (2013.01); *G09G 2320/028* (2013.01); *G09G 2320/068* (2013.01)

(58) Field of Classification Search
CPC ..... G02F 1/134336; G02F 1/1362; G02F 2001/133776; G09G 3/3607; G09G 3/3611; G09G 3/3614; G09G 3/3648; G09G 3/3659; G09G 3/3677; G09G 3/3688; G09G 2300/0426; G09G 2300/0439; G09G 2300/0447; G09G 2300/0452; G09G 2310/0202; G09G 2310/0205; G09G 2310/0297; G09G 2320/028; G09G 2320/068; H01L 27/124; H01L 27/1214
See application file for complete search history.

(56) References Cited

U.S. PATENT DOCUMENTS 8,395,565 B2 * 3/2013 Somerville ..... G09G 3/3216 345/204
8,441,011 B2 * 5/2013 Yamazaki ..... H01L 27/1225 257/43
8,610,650 B2 * 12/2013 Somerville ..... G09G 3/3216 345/690
8,835,920 B2 * 9/2014 Yamazaki ..... H01L 33/42 257/43
8,941,789 B2 * 1/2015 Yoo ..... G02F 1/13624 349/129
9,490,277 B2 * 11/2016 Yamazaki ..... H01L 33/42
9,754,974 B2 * 9/2017 Yamazaki ..... H01L 27/1255
9,830,873 B2 * 11/2017 Park ..... G09G 3/3648
2004/0070713 A1 * 4/2004 Song ..... G02F 1/133707 349/129
2005/0206795 A1 * 9/2005 Shin ..... G02F 1/133707 349/43
2006/0097971 A1 * 5/2006 Lee ..... G09G 3/3648 345/89
2008/0007664 A1 * 1/2008 Ong ..... G09G 3/3614 349/37
2009/0046216 A1 * 2/2009 Chen ..... G02F 1/13306 349/48
2010/0207857 A1 * 8/2010 Gu ..... G02F 1/133512 345/88
2010/0225842 A1 * 9/2010 Hur ..... G02F 1/13624 349/48
2010/0289732 A1 * 11/2010 Ina ..... G02F 1/134336 345/87
2010/0295760 A1 * 11/2010 Somerville ..... G09G 3/3216 345/82
2010/0295860 A1 * 11/2010 Somerville ..... G09G 3/3216 345/545
2010/0295861 A1 * 11/2010 Somerville ..... G09G 3/3216 345/545
2011/0063557 A1 * 3/2011 Kim ..... G02F 1/134309 349/141
2011/0096260 A1 * 4/2011 Cho ..... G02F 1/136213 349/41
2013/0049001 A1 * 2/2013 Yamazaki ..... H01L 27/1255 257/71
2013/0083263 A1 * 4/2013 Kim ..... G02F 1/134336 349/38
2013/0278877 A1 * 10/2013 Kwon ..... G02F 1/133707 349/123
2014/0267994 A1 * 9/2014 Ryu ..... G02F 1/13439 349/141
2015/0042939 A1 * 2/2015 Park ..... G02F 1/134336 349/144
2015/0077692 A1 * 3/2015 Kim ..... G02F 1/133707 349/139
2015/0116385 A1 * 4/2015 Lee ..... G09G 3/3659 345/694
2015/0243240 A1 * 8/2015 Ryu ..... G09G 3/3607 345/89
2016/0124278 A1 * 5/2016 Ogura ..... G02F 1/133784 349/145
2016/0171946 A1 * 6/2016 Chen ..... G02F 1/134309 345/58
2016/0189640 A1 * 6/2016 Guo ..... G09G 3/3688 345/694
2016/0195776 A1 * 7/2016 Lee ..... G02F 1/134309 349/33
2016/0196790 A1 * 7/2016 Park ..... G09G 3/3648 345/690
2016/0217725 A1 * 7/2016 Jung ..... G09G 3/2022
2016/0223874 A1 * 8/2016 Son ..... G02F 1/134309
2016/0246086 A1 * 8/2016 Woo ..... G02F 1/134336
2016/0299382 A1 * 10/2016 Seo ..... G02F 1/133753
2016/0299399 A1 * 10/2016 Kitani ..... G02F 1/136286
2016/0321978 A1 * 11/2016 Chang ..... G09G 3/3648
2016/0363823 A1 * 12/2016 Lee ..... G02F 1/133707
2016/0377922 A1 * 12/2016 Oh ..... G02F 1/133707 349/96
2017/0153515 A1 * 6/2017 Kim ..... G02F 1/134327
2017/0153517 A1 * 6/2017 Shin ..... G02F 1/134336
2018/0348582 A1 * 12/2018 Woo ..... G02F 1/133707

FOREIGN PATENT DOCUMENTS

CN 101369075 A 2/2009
CN 107505782 A 12/2017

* cited by examiner

PIXEL DRIVING CIRCUIT, PIXEL DRIVING METHOD AND LIQUID CRYSTAL DISPLAY DEVICE

RELATED APPLICATIONS

The present application is a National Phase of International Application Number PCT/CN2018/079657, filed Mar. 20, 2018, and claims the priority of China Application No. 201810168216.7, filed Feb. 28, 2018.

FIELD OF THE INVENTION

The present invention relates to a liquid crystal display field, and more particularly to a pixel driving circuit, a pixel driving method and a liquid crystal display device.

BACKGROUND OF THE INVENTION

The LCD (Liquid Crystal Display) possesses many advantages of being ultra thin, power saved and radiation free. It has been widely utilized in, such as LCDTV, smart phones, digital cameras, tablets, laptop screens or notebook screens, and dominates the flat panel display field.

Most of the liquid crystal displays on the present market are back light type liquid crystal displays, which comprise a shell, a liquid crystal panel located in the shell and a backlight module located in the shell. Generally, a structure of the liquid crystal panel mainly comprises a Color Filter (CF), a Thin Film Transistor Array Substrate (TFT Array Substrate) and a Liquid Crystal Layer positioned inbetween. The working principle is that the light of backlight module is reflected to generate images by applying driving voltages to the two glass substrate for controlling the rotations of the liquid crystal molecules.

Currently, a thin film transistor liquid crystal display (TFT-LCD) can be classified into a twisted nematic (TN) mode, an In-plane switching (IPS) mode, an advanced super dimension switch (ADS) mode, a vertical alignment (VA) mode according to the display modes. The VA mode in the wide viewing angle display technology is widely used in a wide viewing angle liquid crystal display panel because it has a larger viewing angle than the TN mode, and also possesses properties of excellent response time and high contrast.

For earning better wide view angle property for the VA liquid crystal display panel to improve the color shift issue, the multi-domain VA (MVA) technology is commonly utilized, which is to divide a sub pixel into many districts and drive the liquid crystals in respective districts to lie down toward different directions as applying voltage. Thus, the watch results from respective directions can be equal.

At present, the viewing angle of the liquid crystal display device has been enlarged from about 120 degrees to 160 degrees or more. While people enjoy the visual experience brought by the large viewing angle, they also hope to have a narrow viewing angle switching option at the same time to prevent others from seeing some important information or protecting the personal privacy. Therefore, it would be extremely necessary to provide a multi view angle display device that satisfies the various needs of users.

SUMMARY OF THE INVENTION

An objective of the present invention is to provide a pixel driving circuit, which can realize multi view angle display to possess a higher product quality.

Another objective of the present invention is to provide a pixel driving method, which can realize multi view angle display.

An objective of the present invention is to provide a liquid crystal display device, which can realize multi view angle display to possess a higher product quality.

Fore realizing the aforesaid objectives, the present invention first provides a pixel driving circuit comprising: a plurality columns of data lines, a plurality of rows of scan lines, a plurality of auxiliary lines, a plurality of pixel units arranged in an array, a common electrode line and a plurality of control units;

wherein each pixel unit comprises a first sub pixel and a second sub-pixel; each scan line is correspondingly connected to first sub pixels and second sub pixels in a row of pixel units; first sub pixels of each column of pixel units are correspondingly connected to one data line and second sub pixels in each column of pixel units are correspondingly connected to one auxiliary line; each control unit receives a first control signal and the second control signal; and is electrically connected to the common electrode line, and is correspondingly connected to an auxiliary line and a data line of one column of pixel units;

the common electrode line receives a common voltage;

the control unit is controlled by the first control signal and the second control signal to disconnect the corresponding data line from the corresponding auxiliary line and to connect the corresponding auxiliary line to the common electrode line, or to connect the corresponding data line to the corresponding auxiliary line and to disconnect the corresponding auxiliary line from the common electrode line;

the first sub pixel comprises a single domain structure, and the second sub pixel comprises a domain having a domain direction different from a domain direction of the first sub pixel.

The first sub pixel comprises a first thin film transistor and a first pixel electrode; a gate of the first thin film transistor is electrically coupled to a corresponding scan line, and a source of the first thin film transistor is electrically coupled to a corresponding data line; and a drain of the first thin film transistor is electrically coupled to the first pixel electrode; the second sub pixel comprises a second thin film transistor and a second pixel electrode; a gate of the second thin film transistor is electrically coupled to a corresponding scan line; and a source of the second thin film transistor is electrically coupled to a corresponding auxiliary line, and a drain of the second thin film transistor is electrically coupled to the second pixel electrode;

the first pixel electrode comprises a single domain structure; and the second pixel electrode comprises a domain having a domain direction different from a domain direction of the first pixel electrode.

The control unit comprises a third thin film transistor and a fourth thin film transistor; a gate of the third thin film transistor receives a first control signal, and a source of the third thin film transistor is electrically coupled to a corresponding data line, and a drain of the third thin film transistor is electrically coupled to a corresponding auxiliary line; a gate of the fourth thin film transistor receives a second control signal, and a source of the fourth thin film transistor is electrically coupled to the common electrode line, and a drain of the fourth thin film transistor is electrically coupled to a corresponding auxiliary line.

Both the third thin film transistor and the fourth thin film transistor are P type thin film transistors or N type thin film transistors, and the first control signal and the second control signal have opposite potentials.

The second sub pixel is a multi domain structure; or the second sub pixel is a single domain structure having a domain direction different from a domain direction of the first sub pixel.

The pixel driving circuit further comprises a gate driver and a source driver, wherein a plurality of data lines is coupled to the source driver, and a plurality of scan lines is coupled to the gate driver.

The present invention further provides a pixel driving method, applied to the foregoing pixel driving circuit, comprising steps of:

controlling the control unit by a first control signal and a second control signal to disconnect the corresponding data line from the corresponding auxiliary line and to connect the corresponding auxiliary line to the common electrode line;

controlling the control unit by the first control signal and the second control signal to connect the corresponding data line to the corresponding auxiliary line and to disconnect the corresponding auxiliary line from the common electrode line.

The present invention further provides a liquid crystal display device, comprising the foregoing pixel driving circuit.

The benefits of the present invention are: each pixel unit of the pixel driving circuit provided by the present invention comprises a first sub pixel and a second sub pixel. A first sub pixel and a second sub pixel in a column of pixel units are respectively connected to one data line and one auxiliary line, and meanwhile, a plurality of control units receiving the first control signal and the second control signal and being electrically coupled to the common electrode line is arranged. Each control unit is correspondingly coupled to an auxiliary line and a data line connected to a column of pixel units. The control unit is controlled by the first control signal and the second control signal to disconnect the corresponding data line from the corresponding auxiliary line and to connect the corresponding auxiliary line to the common electrode line, or to connect the corresponding data line to the corresponding auxiliary line and to disconnect the corresponding auxiliary line from the common electrode line. Only the first sub pixel is lit in a narrow viewing angle display, and the first sub pixel and second sub pixel are simultaneously lit in a wide viewing angle display; thereby realizing multi view angle display. The pixel driving method provided by the present invention can realize the multi view angle display and is beneficial to improve product quality. The liquid crystal display device provided by the present invention can perform multi view angle display and the product quality is high.

BRIEF DESCRIPTION OF THE DRAWINGS

In order to better understand the characteristics and technical aspect of the invention, please refer to the following detailed description and accompanying drawings of the present invention. However; the drawings are provided for reference only and are not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
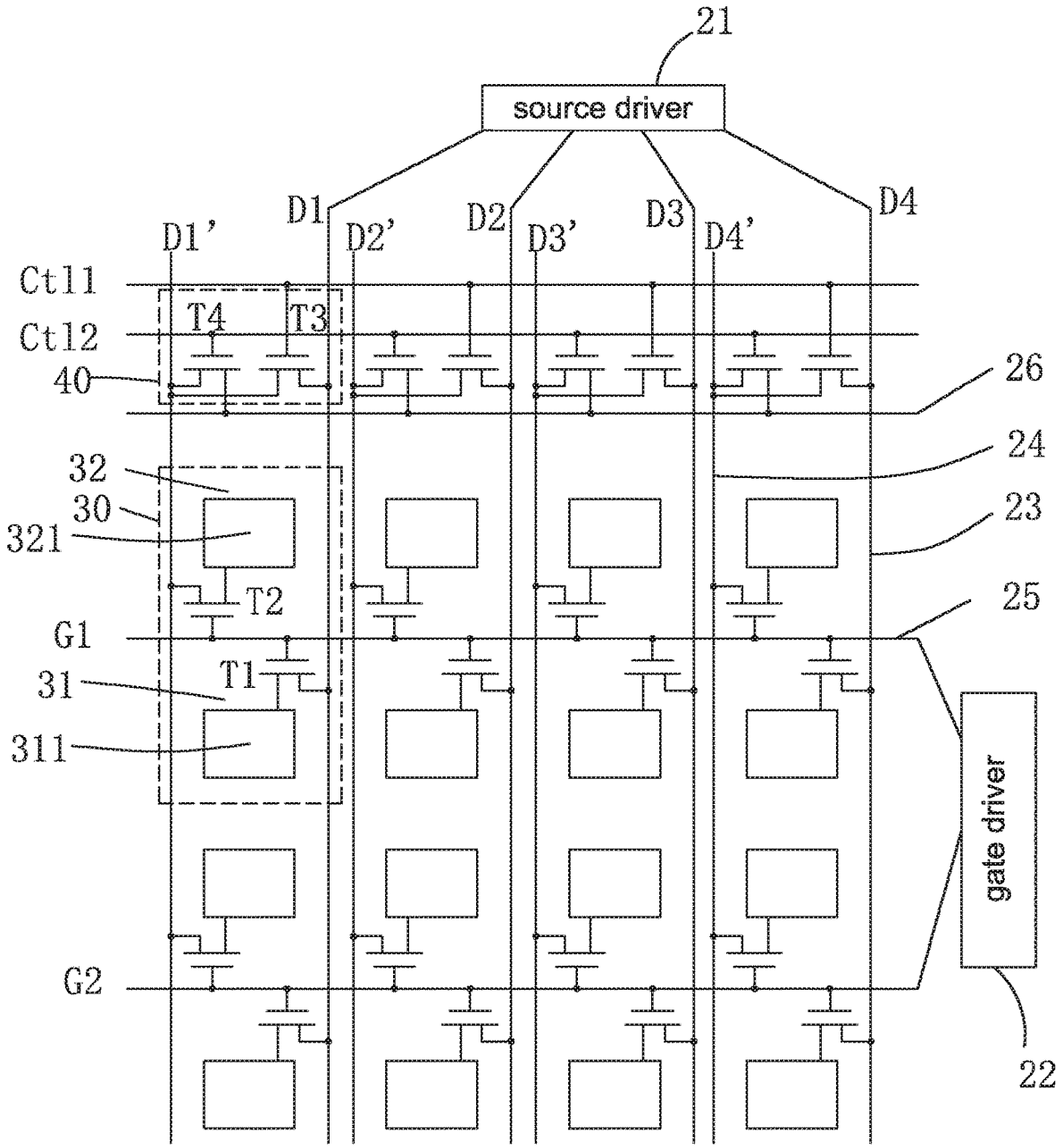
FIG. 1 is a structural diagram of a pixel driving circuit according to the present invention.

Please refer to FIG. 1. The present invention provides a pixel driving circuit, comprising a plurality of columns of data lines 23 (D1, D2, D3, D4, . . . in FIG. 1) aligned in a row direction, and a plurality of rows of scan lines 25 aligned in a column direction (G1, G2, . . . in FIG. 1), a plurality of auxiliary lines 24 aligned in the row direction (D1', D2', D3', D4', . . . in FIG. 1), and a source driver 21, connected to a plurality of data lines 23, a gate driver 22, connected to a plurality of scan lines 25, a common electrode line 26, a plurality of pixel units 30 arranged in an array and a plurality of control units 40.

Each pixel unit 30 comprises a first sub pixel 31 and a second sub pixel 32. Each scan line 25 is correspondingly coupled to the first sub pixel 31 and the second sub pixel 32 in one row of pixel units 30. The first sub pixels 31 of each column of pixel units 30 are correspondingly coupled to one data line 25, and the second sub pixels 32 of each column of pixel units 30 are correspondingly coupled to one auxiliary line 24. Each control unit 40 receives a first control signal Ctl1 and a second control signal Ctl2 and is electrically coupled to the common electrode line 26, and is correspondingly coupled to the auxiliary line 24 and the data line 25 coupled to the column of pixel units 30.

the first sub pixel 31 comprises a single domain structure, and the second sub pixel 32 comprises a domain having a domain direction different from a domain direction of the first sub pixel 31.

The scan voltage signal is supplied to each scan line 25 via the gate driver 22. The data voltage signal is supplied to each data line 23 via the source driver 21. The common electrode line 26 is used to provide a common voltage. The potentials and the sequences (timings) of the scan voltage signal and the data voltage signal in the present invention can be provided according to the potentials and the timings of the scan voltage signal and the data voltage signal of the pixel driving circuit in the prior art.

The control unit 40 is controlled by the first control signal Ctl1 and the second control signal Ctl2 to disconnect the corresponding data line 23 from the corresponding auxiliary line 24 and to connect the corresponding auxiliary line 24 to the common electrode line 26, or to connect the corresponding data line 23 to the corresponding auxiliary line 24 and to disconnect the corresponding auxiliary line 24 from the common electrode line 26.

The first sub pixel 31 comprises a first thin film transistor T1 and a first pixel electrode 311. A gate of the first thin film transistor T1 is electrically coupled to a corresponding scan line 25, and a source of the first thin film transistor is electrically coupled to a corresponding data line 23, and a drain of the first thin film transistor is electrically coupled to the first pixel electrode 311. The second sub pixel 32 comprises a second thin film transistor T2 and a second pixel electrode 321. A gate of the second thin film transistor T2 is electrically coupled to a corresponding scan line 25, and a source of the second thin film transistor is electrically coupled to a corresponding auxiliary line 24, and a drain of the second thin film transistor is electrically coupled to the second pixel electrode 321.

The first pixel electrode 311 comprises a single domain structure, and the second pixel electrode 321 comprises a domain having a domain direction different from a domain direction of the first pixel electrode 311.

In the preferred embodiment of the present invention, the control unit 40 comprises a third thin film transistor T3 and a fourth thin film transistor T4. A gate of the third thin film transistor T3 receives a first control signal CM and a source of the third thin film transistor is electrically coupled to a corresponding data line 25, and a drain of the third thin film transistor is electrically coupled to a corresponding auxiliary line 24. A gate of the fourth thin film transistor T4 receives a second control signal Crl2, and a source of the fourth thin film transistor is electrically coupled to the common electrode line 26, and a drain of the fourth thin film transistor is electrically coupled to a corresponding auxiliary line 24.

Both the third thin film transistor T3 and the fourth thin film transistor T4 are P type thin film transistors or N type thin film transistors, and the first control signal Crl1 and the second control signal Crl2 have opposite potentials.

In the preferred embodiment of the present invention, both the third thin film transistor T3 and the fourth thin film transistor T4 are N type thin film transistors.

The second sub pixel 32 can be a multi domain structure or a single domain structure having a domain direction different from a domain direction of the first sub pixel 31.

Correspondingly, the second pixel electrode 321 can be a multi domain structure or a single domain structure having a domain direction different from a domain direction of the first pixel electrode 311.

As the second sub pixel 32 has a dual domain structure, the structure can adopt a dual domain structure, which is commonly used in the prior art. For instance, the structure of the second pixel electrodes 321 of the second sub pixels 32 may be a plurality of openings sequentially arranged on the entire surface of the electrode. Each opening comprises a first strip portion and a second strip portion, which are sequentially connected. The extending direction of the first strip portion and the extending direction of the second strip portion are different so that the second sub pixel 32 has a dual domain structure.

As the second sub pixel 32 is a multi domain structure with more than two domains, the structure may adopt a multi domain structure, which is commonly used in the prior art. For instance, the second pixel electrode 321 of the second sub pixel 32 may be a pozidriv slit electrode, including a vertical trunk and a horizontal trunk, which perpendicularly intersect with each other, and the entire area of the second pixel electrode 321 is evenly divided into four sub areas. Each pixel electrode area is composed with spread strip branches (slit) appearing ±45 degree, ±135 degree angles with the vertical trunk or the horizontal trunk. The respective strip branches are positioned in the same plane with the vertical trunk or the horizontal trunk. The oblique electric field generated by the pixel electrode pattern induces the liquid crystal molecules in different areas to fall in different directions to achieve 4 domains. For another instance, the second pixel electrode 321 of the second sub pixel 32 may be configured such that an opening having a shape similar to the aforementioned pozidriv slit electrode is provided on the entire surface of the electrode to realize 4 domains.

Figure 2:
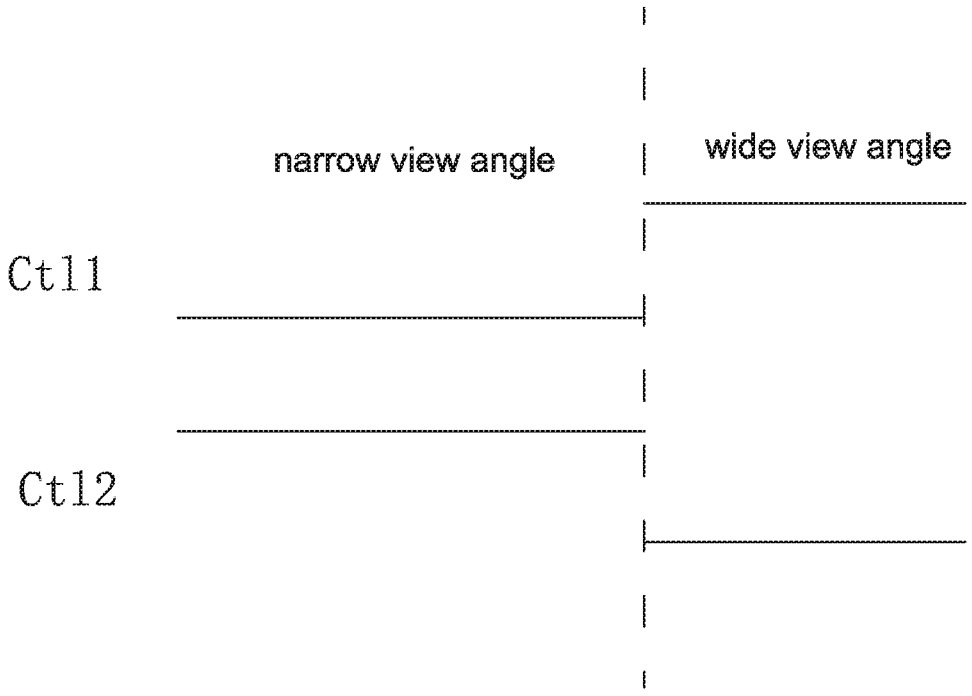
FIG. 2 is a sequence control diagram of a pixel driving circuit according to the present invention.

The embodiment shown in FIG. 1 and FIG. 2 is illustrated as an example. The working process of the pixel driving circuit of the present invention is:

As the narrow viewing angle display is implemented, the first control signal Ctl1 is at a low potential to deactivate the third thin film transistors T3 in the plurality of control units 40 for disconnecting the data line 23 coupled to each column of pixel units 30 from the auxiliary lines 24 coupled to the column of pixel units 30. Meanwhile, the second control signal Ctl2 is at a high potential to activate the fourth thin film transistors T4 in the plurality of control units 40 for connecting the plurality of auxiliary lines 24 to the common electrode line 26. Then, the gate driver 22 sequentially provides scan voltage signals to the plurality of rows of scan lines 25. After the source driver 21 provides data voltage signals to the plurality of data lines 23, each data line 23 transmits the data voltage signal thereon to the first sub pixel 31 in the corresponding pixel unit 30, and all the second sub pixels 32 receives a common voltage on the common electrode line 26 through the auxiliary line 25 coupled thereto. Therefore, at this time, only the first sub pixel 31 in each pixel unit 30 is lit, and the second sub pixel 32 is not lit. Since the first sub pixel 31 is a single domain structure, the narrow viewing angle display is implemented.

As the wide viewing angle display is implemented, the first control signal Ctl1 is at a high potential to activate the third thin film transistors T3 in the plurality of control units 40 for connecting the data line 23 coupled to each column of pixel units 30 to the auxiliary lines 24 coupled to the column of pixel units 30. Meanwhile, the second control signal Ctl2 is at a low potential to deactivate the fourth thin film transistors T4 in the plurality of control units 40 for disconnecting the plurality of auxiliary lines 24 from the common electrode line 26. Then, the gate driver 22 sequentially provides scan voltage signals to the plurality of rows of scan lines 25. After the source driver 21 provides data voltage signals to the plurality of data lines 23, each data line 23 transmits the data voltage signal thereon to the auxiliary lines 24 coupled thereto, and both the first sub pixel 31 and the second sub pixel 32 of each pixel unit 30 receive the same data voltage signal. Therefore, at this time, both the first sub pixel 31 and the second sub pixel 32 in each pixel unit 30 are lit. Since the second sub pixel 32 comprises a domain having a domain direction different from a domain direction of the first sub pixel 31, the first sub pixel 31 and the second sub pixel 32 are simultaneously lit to form a multi domain structure. The display viewing angle can be expanded. The narrow viewing angle display is implemented. Therefore, the pixel driving circuit of the present invention can be switched between the wide viewing angle display and the narrow viewing angle display, that is, a multi view display function is realized. As being applied to a liquid crystal display device, the application scope of the liquid crystal display device can be extended to improve product quality.

Figure 3:
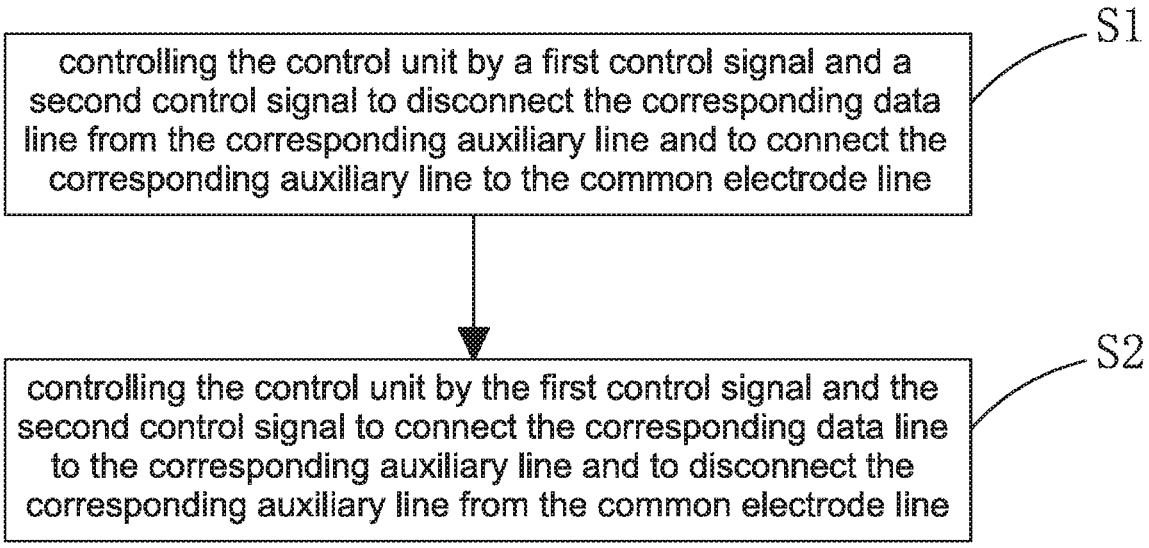
FIG. 3 is a flowchart of a pixel driving method according to the present invention.

Referring to FIG. 3 in conjunction with FIG. 1 and FIG. 2, on the basis of the same inventive idea, the present invention further provides a pixel driving method applied to the foregoing pixel driving circuit, comprising steps of:

Step S1, entering the narrow view angle display mode, controlling the control unit 40 by the first control signal Ctl1 and the second control signal Ctl2 to disconnect the corresponding data line 23 from the corresponding auxiliary line 24 and to connect the corresponding auxiliary line 24 to the common electrode line 26.

As the narrow viewing angle display is implemented, the first control signal Ctl1 is at a low potential to deactivate the third thin film transistor T3 in the plurality of control units 40 for disconnecting the data line 23 coupled to each column of pixel units 30 from the auxiliary lines 24 coupled to the column of pixel units 30. Meanwhile, the second control signal Ctl2 is at a high potential to activate the fourth thin film transistors T4 in the plurality of control units 40 for connecting the plurality of auxiliary lines 24 to the common electrode line 26. Then, the gate driver 22 sequentially provides scan voltage signals to the plurality of rows of scan lines 25. After the source driver 21 provides data voltage signals to the plurality of data lines 23, each data line 23 transmits the data voltage signal thereon to the first sub pixel 31 in the corresponding pixel unit 30, and all the second sub pixels 32 receives a common voltage on the common electrode line 26 through the auxiliary line 25 coupled thereto. Therefore, at this time, only the first sub pixel 31 in each pixel unit 30 is lit, and the second sub pixel 32 is not lit. Since the first sub pixel 31 is a single domain structure, the narrow viewing angle display is implemented.

Step S2, entering the wide view angle display mode, controlling the control unit 40 by the first control signal Ctl1 and the second control signal Ctl2 to connect the corresponding data line 23 to the corresponding auxiliary line 24 and to disconnect the corresponding auxiliary line 24 from the common electrode line 26.

In step S2 of the embodiment shown in FIG. 1 and FIG. 2, the first control signal Ctl1 is at a high potential to activate the third thin film transistors T3 in the plurality of control units 40 for connecting the data line 23 coupled to each column of pixel units 30 to the auxiliary lines 24 coupled to the column of pixel units 30. Meanwhile, the second control signal Ctl2 is at a low potential to deactivate the fourth thin film transistors T4 in the plurality of control units 40 for disconnecting the plurality of auxiliary lines 24 from the common electrode line 26, Then, the gate driver 22 sequentially provides scan voltage signals to the plurality of rows of scan lines 25, After the source driver 21 provides data voltage signals to the plurality of data lines 23, each data line 23 transmits the data voltage signal thereon to the auxiliary lines 24 coupled thereto, and both the first sub pixel 31 and the second sub pixel 32 of each pixel unit 30 receive the same data voltage signal. Therefore, at this time, both the first sub pixel 31 and the second sub pixel 32 in each pixel unit 30 are lit, Since the second sub pixel 32 comprises a domain having a domain direction different from a domain direction of the first sub pixel 31, the first sub pixel 31 and the second sub pixel 32 are simultaneously lit to form a multi domain structure. The display viewing angle can be expanded. The narrow viewing angle display is implemented.

According to the pixel driving method of the present invention, a plurality of control units 40 are provided. The control unit 40 is controlled by the first control signal Ctl1 and the second control signal Ctl2. As the narrow viewing angle display is implemented, only the first pixel 31 in each pixel unit 30 can be lit. As the wide viewing angle display is implemented, the first sub pixel 31 and the second sub pixel 32 in each pixel unit 30 are lit, thereby realizing multi view angle display and realizing the switching between the wide view angle display and the narrow view angle display, i.e., realizing the function of multi view angle display. As being applied to a liquid crystal display device, the application scope of the liquid crystal display device can be extended and the product quality can be improved.

On the basis of the same inventive idea, the present invention further provides a liquid crystal display device, comprising the foregoing pixel driving circuit. The description of the structure of the pixel driving circuit is not repeated herein.

According to the pixel driving device of the present invention, a plurality of control units 40 are provided. The control unit 40 is controlled by the first control signal Ctl1 and the second control signal Ctl2. As the narrow viewing angle display is implemented, only the first pixel 31 in each pixel unit 30 can be lit. As the wide viewing angle display is implemented, the first sub pixel 31 and the second sub pixel 32 in each pixel unit 30 are lit, thereby realizing multi view angle display and realizing the switching between the wide view angle display and the narrow view angle display, i.e., realizing the function of multi view angle display. The application scope of the liquid crystal display device can be extended and the product quality can be improved.

In conclusion, each pixel unit of the pixel driving circuit according to the present invention comprises a first sub pixel and a second sub pixel. A first sub pixel and a second sub pixel in a column of pixel units are respectively connected to one data line and one auxiliary line, and meanwhile, a plurality of control units receiving the first control signal and the second control signal and being electrically coupled to the common electrode line is arranged. Each control unit is correspondingly coupled to an auxiliary line and a data line connected to a column of pixel units. The control unit is controlled by the first control signal and the second control signal to disconnect the corresponding data line from the corresponding auxiliary line and to connect the corresponding auxiliary line to the common electrode line, or to connect the corresponding data line to the corresponding auxiliary line and to disconnect the corresponding auxiliary line from the common electrode line. Only the first sub pixel is lit in a narrow viewing angle display, and the first sub pixel and second sub pixel are simultaneously lit in a wide viewing angle display, thereby realizing multi view angle display. The pixel driving method of the present invention can realize the multi view angle display and is beneficial to improve product quality. The liquid crystal display device of the present invention can perform multi view angle display and the product quality is high.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A pixel driving circuit comprising: a plurality columns of data lines, a plurality of rows of scan lines, a plurality of auxiliary lines, a plurality of pixel units arranged in an array; a common electrode line and a plurality of control units;

wherein each pixel unit comprises a first sub pixel and a second sub-pixel; each scan line is correspondingly connected to first sub pixels and second sub pixels in a row of pixel units; first sub pixels of each column of pixel units are correspondingly connected to one data line and second sub pixels in each column of pixel units are correspondingly connected to one auxiliary line; each control unit receives a first control signal and the second control signal, and is electrically connected to the common electrode line, and is correspondingly connected to an auxiliary line and a data line of one column of pixel units;

the common electrode line receives a common voltage;

the control unit is controlled by the first control signal and the second control signal to disconnect the corresponding data line from the corresponding auxiliary line and to connect the corresponding auxiliary line to the common electrode line, or to connect the corresponding data line to the corresponding auxiliary line and to disconnect the corresponding auxiliary line from the common electrode line;

the first sub pixel comprises a single domain structure, and the second sub pixel comprises a domain having a domain direction different from a domain direction of the first sub pixel.

2. The pixel driving circuit according to claim 1, wherein the first sub pixel comprises a first thin film transistor and a first pixel electrode; a gate of the first thin film transistor is electrically coupled to a corresponding scan line, and a source of the first thin film transistor is electrically coupled to a corresponding data line, and a drain of the first thin film transistor is electrically coupled to the first pixel electrode; the second sub pixel comprises a second thin film transistor and a second pixel electrode; a gate of the second thin film transistor is electrically coupled to a corresponding scan line, and a source of the second thin film transistor is electrically coupled to a corresponding auxiliary line, and a drain of the second thin film transistor is electrically coupled to the second pixel electrode;

the first pixel electrode comprises a single domain structure, and the second pixel electrode comprises a domain having a domain direction different from a domain direction of the first pixel electrode.

3. The pixel driving circuit according to claim 1, wherein the second sub pixel is a multi domain structure; or the second sub pixel is a single domain structure having a domain direction different from a domain direction of the first sub pixel.

4. The pixel driving circuit according to claim 1, further comprising a gate driver and a source driver, wherein a plurality of data lines is coupled to the source driver, and a plurality of scan lines is coupled to the gate driver.

5. A pixel driving method, applied to the pixel driving circuit according to claim 1, comprising steps of:

controlling the control unit by a first control signal and a second control signal to disconnect the corresponding data line from the corresponding auxiliary line and to connect the corresponding auxiliary line to the common electrode line;

controlling the control unit by the first control signal and the second control signal to connect the corresponding data line to the corresponding auxiliary line and to disconnect the corresponding auxiliary line from the common electrode line.

6. A liquid crystal display device, comprising the pixel driving circuit according to claim 1.

7. The pixel driving circuit according to claim 1, wherein the control unit comprises a third thin film transistor and a fourth thin film transistor; a gate of the third thin film transistor receives a first control signal, and a source of the third thin film transistor is electrically coupled to a corresponding data line, and a drain of the third thin film transistor is electrically coupled to a corresponding auxiliary line; a gate of the fourth thin film transistor receives a second control signal, and a source of the fourth thin film transistor is electrically coupled to the common electrode line, and a drain of the fourth thin film transistor is electrically coupled to a corresponding auxiliary line.

8. The pixel driving circuit according to claim 7, wherein both the third thin film transistor and the fourth thin film transistor are P type thin film transistors or N type thin film transistors, and the first control signal and the second control signal have opposite potentials.

* * * * *